United States Patent [19]

Napier

[11] Patent Number: 5,065,839

[45] Date of Patent: Nov. 19, 1991

[54] ESCAPE SYSTEM

[76] Inventor: George W. Napier, 19 Hadrian Court, Darras Hall, Ponteland, Newcastle-upon-Tyne NE20 9JU, England

[21] Appl. No.: 365,931

[22] Filed: Jun. 12, 1989

[30] Foreign Application Priority Data

Jun. 14, 1988 [GB] United Kingdom ..... 8814101

[51] Int. Cl.[5] ..... H62B 1/02

[52] U.S. Cl. ..... 182/47; 182/142; 182/236

[58] Field of Search ..... 182/47, 142, 143, 150, 182/145, 240, 236

[56] References Cited

U.S. PATENT DOCUMENTS

| | | | |
|---|---|---|---|
| 665,707 | 1/1901 | Tromanhauser | 182/142 X |
| 1,027,724 | 5/1912 | Haney | 182/142 |
| 3,010,533 | 11/1961 | Ross | 182/47 X |
| 4,355,699 | 10/1982 | Smith, Jr. | 182/142 X |
| 4,406,351 | 9/1983 | Littlejohn et al. | 182/47 |
| 4,640,384 | 2/1987 | Kuller et al. | 182/142 X |

FOREIGN PATENT DOCUMENTS

| | | | |
|---|---|---|---|
| 0232479 | 8/1987 | European Pat. Off. | 182/142 |
| 3018375 | 12/1981 | Fed. Rep. of Germany | 182/47 |

*Primary Examiner*—Alvin C. Chin-Shue

*Attorney, Agent, or Firm*—Rodman & Rodman

[57] ABSTRACT

An escape system for enabling occupants to escape from the upper levels of buildings includes a vessel suspended from at least two fire-resistant cables spaced apart upon the surface of the vessel, the vessel itself being of fire-resistant material and being substantially air-tight, a bridge affording access for personnel from an adjacent building to the vessel, and lift means for retracting the cables and thus lifting the vessel.

8 Claims, 2 Drawing Sheets

ESCAPE SYSTEM

The present invention is an escape system, suitable for enabling occupants to escape from upper levels of buildings, especially of multi-story or so-called "high rise" buildings.

When fire or a similar emergency occurs in a tall building, occupants may very easily become isolated from normal means of escape. Thus, for example, they may be trapped above a fire level and be unable to reach ground level via a stairway or other conventional escape route. Mobile escape ladders have a very limited upward reach compared with the height of many modern buildings and occupants may therefore be dependent on rescue from the roof of the building by helicopter. However such helicopters may not be available nearby and are usually of limited carrying capacity when available. In addition, access to the roof may be impossible or restricted by smoke or other hazards.

There remains a need for a reliable, accessible and readily-used alternative means of escape from the upper stories of tall buildings. It is an object of the present invention to fulfil that need.

With this object in mind, the present invention is an escape system, which comprises a vessel, suspended from at least two fire-resistant cables spaced apart upon the surface of the vessel, said vessel itself being of fire-resistant material and being substantially air-tight, bridge means affording access for personnel from an adjacent building to said vessel, and lift means for retracting said cables and thereby lifting said vessel.

The invention thus provides an escape vessel which may be lowered by the lift means and cables into a position in which occupants of a building may enter the vessel, for example from a window of the building, over the bridge means and then be safely lowered or lifted to a secure place away from the fire or other hazard which made escape necessary.

The vessel, which is hereinafter referred to as the escape capsule, is preferably large enough to accommodate a substantial number of people, by which is meant at least 10 persons and preferably up to 50 persons. Individual seats or longitudinal or transverse benches may be provided within the vessel. Such seats or benches will be affixed within the vessel or may be formed integral with the shell of the vessel. In a preferred form of the invention, the seating takes the form of a continuous bench extending around at least a part of the internal perimeter of the vessel. Less satisfactorily, occupants may be required to stand or lie down within the vessel. Provision may be made to accommodate stretchers carrying injured persons. Whatever the form of seating or alternative support for the occupants, it is much preferred that seat belts or similar restraining harnesses be provided.

The escape capsule is preferably of a smooth external shape in order to minimise the effects of wind upon the capsule while it is being raised or lowered, which otherwise tends to cause the capsule to swing at the end of its supporting cables. In order to optimise the strength of the vessel for a given weight, the capsule is preferably spherical or cylindrical. It is particularly preferred that the capsule take the form of an elongated cylinder, preferably with convex ends, suspended with its cylindrical axis in a generally horizontal position. In this form of the capsule, it is more readily possible to provide a range of capsules of different capacity, all of the same diameter but of different axial lengths.

The capsule is suspended from at least two fire-resistant cables. Preferably the cables are wire cables and, in the case of an elongated capsule such as a cylindrical one, the cables are desirably attached at two points spaced apart by a significant distance down the axial length of the capsule.

The capsule is of fire-resistant material as stated above. For example it may be of steel or of a fire-resistant alloy. In a preferred alternative form, the capsule may be of a glass-reinforced plastic, that is, of a fire-resistant resin reinforced with glass fibres. Such materials have become available for the manufacture of marine survival craft and have been shown to be able to maintain acceptable internal temperatures when the vessel is surrounded by temperatures in excess of 1000° C. In one embodiment of the invention, especially when the capsule is constructed of a heat-conducting metal, it is double-skinned to reduce the transmission of external heat to the interior of the capsule. In that embodiment, the space between the skins may be occupied by a heat-insulating material. Further thermal protection may in any case be provided in the form of a system for drenching the outside surface of the capsule with water carried in one or more tanks within the capsule, or for surrounding the capsule with a fine mist water curtain supplied from such an internal source.

The capsule may be provided with windows, especially when its operation is controlled from within the capsule, or may be windowless. It may have a single access door or may have more than one such door, for example two doors spaced from each other down one side of the capsule. It may in this way be designed for access from one side only or may have one or more doors on each of its sides, for example to assist ready evacuation from the capsule at ground level. All such windows and doors should be airtight in their closed positions, in order to isolate the internal atmosphere of the capsule from the ambient, potentially hazardous atmosphere. Thus the capsule should have its own source of a life-supporting atmosphere. This may take the form of an atmosphere for the interior of the vessel, provided by air bottles, for example to establish a controlled slight internal pressure to prevent the ingress of smoke and toxic fumes. Individual oxygen masks may alternatively or additionally be provided, for example to provide an emergency source of support if the capsule shell becomes punctured.

The bridge means by which access to the capsule is achieved may be mounted or mountable upon the building but in a particularly preferred form of the invention the bridge means is pivotally mounted upon the vessel itself, for pivoting between respective stowed and operative positions. Preferably it is so pivoted that it lies flush upon or within the surface of the capsule when in its stowed position. Preferably the bridge means is pivoted at or adjacent to its lower edge, so that it is pivotable downwardly from its stowed to its operative position, wherein, if desired, it may reversibly be locked to prevent further movement while in use. In one particularly preferred form of the invention, one or more of the access doors of the capsule are hinged at their lower edges so as to function as the bridge means. If desired, especially where certain windows and/or doors of the building are specifically designated for escape purposes, means of temporary attachment of the capsule to the building adjacent to those windows or doors may be provided. For example hooks associated with the outer edge of the bridge means may be designed to engage lugs on the building.

The lift means may be cranes, or more preferably davits, positioned at the top of the building, preferably upon the roof but alternatively on a ledge within the region of the roof or, particularly in the case of very tall buildings, at a lower level. It is essential that the capsule be lifted uniformly by both cables and, to that end, the powered winches which retract the two cables are preferably linked together, or combined in the form of a double-drum winch. Assuming that the capsule will normally be stowed at a point above that at which access to it from the building will be required if an emergency arises, then the capsule can be lowered into position by gravity, in which case it may be operated even if all power to the building fails. However it will normally be necessary subsequently to return the capsule to its stowed position, or in some situations it may be necessary or desirable to transfer the occupants to an upper position for escape purposes. For these reasons, a powered drive to the lift means will normally be provided. The lift means is preferably electrically driven but may alternatively be driven by a different source of power, for example a diesel engine. In one form the lift means is powered by one or more electrical batteries. Such batteries may be of the rechargeable type. The recharging may possibly be effected by the action of lowering the capsule under gravity.

The lift means may if desired be mounted upon a carriage, especially a carriage running upon a track, to enable the capsule to be moved to different operating points around the circumference of the building. Two or more capsules and associated lift means may be provided, for example one for each vertical face of a multi-sided building. If the building is of exceptional height, for example if it would be impracticable to provide for suitable long suspension cables, then it may be desired to arrange for a capsule or capsules to be stowed at, and suspended from, an intermediated position in the height of the building. It may then be desired to provide for transition of passengers between capsules at that intermediate position.

Access to any capsule from the building is preferably from a pre-designated firesafe area and particularly preferably via an air lock exit facility.

Operation of the lift means may be controlled from one or more points upon or adjacent to the building, for example from roof level and/or ground level, and/or from within the escape capsule.

It will not normally be necessary to provide any drive power on the capsule itself; however preferably the capsule has its own independent source of electrical power to provide internal and optionally external lighting and optionally also a means of communication between its occupants and their rescuers.

In one embodiment of the system according to the invention, the capsule is designed to operate as fire-fighting vehicle. For this purpose, it may be provided with such features as monitors for water or foam, fed for example from ground hoses or fire hydrants, and fire extinguishers. It may also carry closed-circuit television equipment, one or more searchlights and/or first aid facilities and may be fitted with one or more protected observation positions.

The invention will now be further described with reference to the accompanying drawings, which illustrate schematically two specific preferred embodiments of the escape system according to the invention and wherein.

Figure 1:
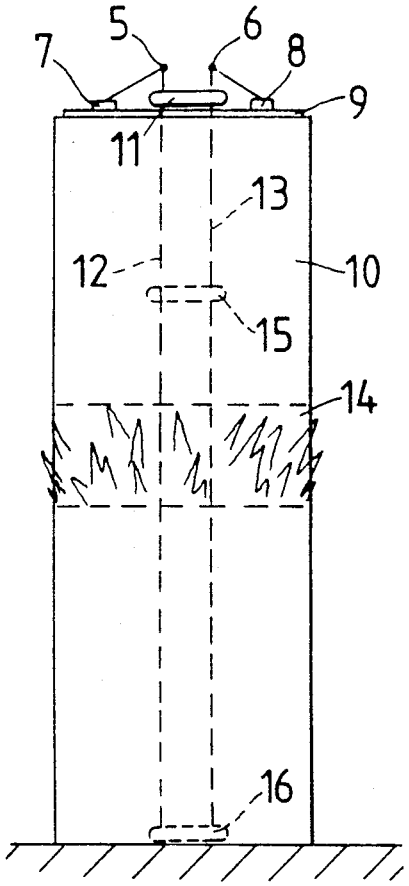
FIG. 1 is an elevation of a building fitted with a first embodiment of the escape system.

Referring firstly to FIG. 1, a unit comprising two davits 5, 6 and two winches 7, 8 is mounted upon a carriage for movement along a track 9, by means of which the position of the unit along the top edge of one face of a building 10 may be adjusted. Slung by a pair of wire cables 12, 13 below the davits is an escape capsule 11. When the davits are swung about vertical axes into an outboard position, the capsule 11 may be lowered on the cables 12, 13 by controlled operation of the winches 7, 8 into a portion close to the side of the building. Thus, for example, if an intermediate zone of the height of the building such as that indicated by the reference numeral 14 is seriously affected by fire and/or smoke, persons trapped above that zone may enter the capsule 11 at an escape position 15 and be lowered past the fire to ground level at 16.

Figure 2:
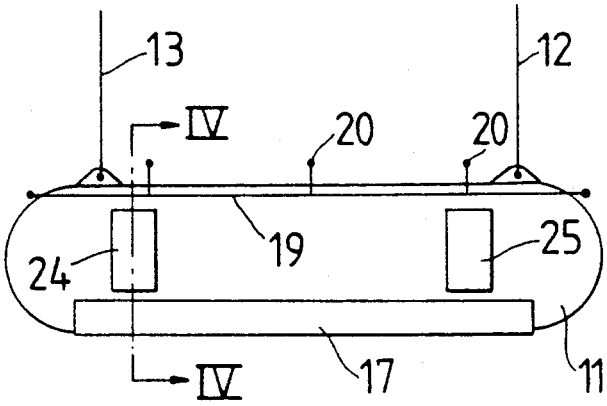
FIG. 2 is an elevation, to a larger scale, of an escape capsule.
Figure 3:
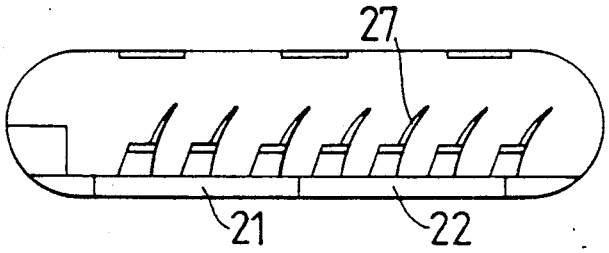
FIG. 3 is a longitudinal sectional view corresponding to FIG. 2.
Figure 4:
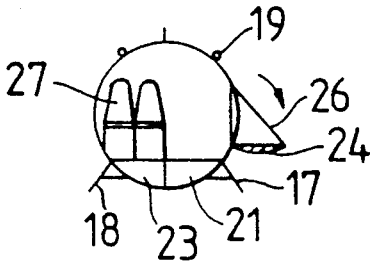
FIG. 4 is a transverse sectional view on the line IV—IV of FIG. 2.

As shown in FIGS. 2 to 4, the escape capsule 11 is an elongated cylindrical vessel with convex ends. The capsule is made of steel and is air-tight. Outriggers 17, 18 are fitted along the two sides of the capsule, both to stabilise the capsule at ground level and also to brace the capsule against the face of the building when in use.

A water drenching system 19, with nozzels 20, extends along the top and upper areas of the sides of the capsules, to enable the capsule to be water-cooled when the outside temperature is excessive. Water tanks 21, 22, 23 built within the bottom part of the capsule 11 provide the water for this purpose, the water drenching system being energised by pressurised inert gas cylinders associated with the individual tanks. Alternatively, the water tanks may be located within the roof of the capsule and may then supply the drenching system by gravity feed.

Two doors 24, 25 are mounted in the side of the capsule 11 which is nearer to the building. Each of these doors is hinged at its lower edge so that, as illustrated in FIG. 4, it may swing downwards from its normal closed position, in the direction of the arrow, into a horizontal position in which it forms a bridge from the building into the capsule. In this position, the door is braced by stays 26.

Within the capsule, in this illustrated embodiment, fixed, well-padded seats 27 are fitted, each provided with a seat belt (not shown).

Figure 5:
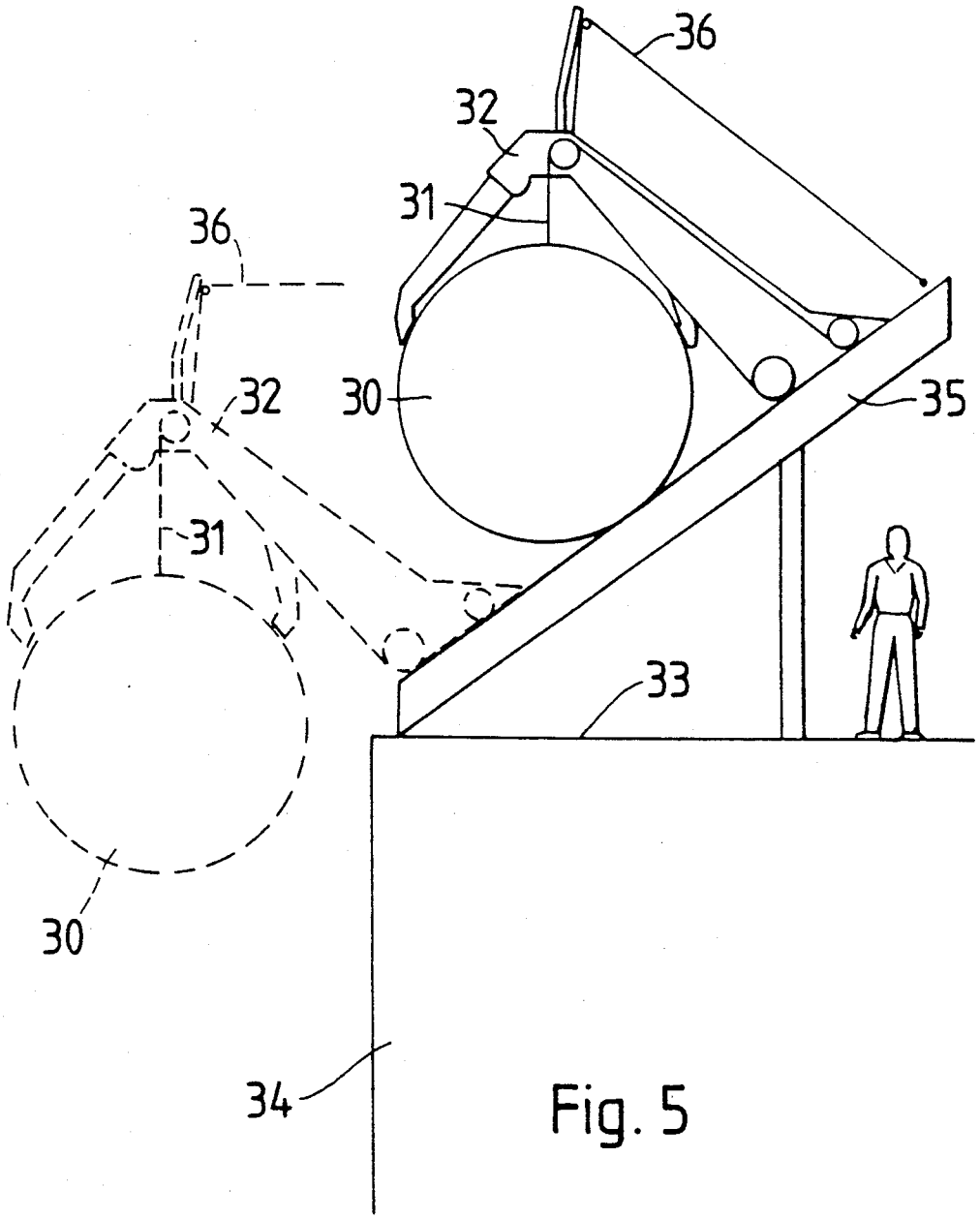
FIG. 5 illustrates, in elevation from one end, a second embodiment of the escape system of the present invention.

FIG. 5 shows an alternative, and preferred, method of mounting the capsule. The illustrated capsule 30 is formed in fire-resistant glass-reinforced plastic in a mould which is adapted to be lenghtened by the inclusion of additional pieces within its length. The capsule 30 is of a similar round-ended cylindrical shape to the capsule 11. By extending the mould as mentioned, further capsules of the same diameter but greater length (and therefore greater capacity) may be made as desired using the same mould. The illustrated capsule, by way of example, is approximately 10 meters long and rather less than 3 meters in diameter.

The capsule 30 is suspended by two cables 31, spaced apart along the length of the capsule, from a pair of davits 32. Of course, only one divat 32 and cable 31 is visible in this end elevation. Each cable 31 is formed as a loop extending from a common winch (not shown) mounted upon the roof 33 of a building 34.

The two davits 32 are supported for linear movement upon a pair of fixed, inclined parallel trackways 35, by means of which the davits, with the capsule 30 suspended beneath them, may be moved from the inboard position above the roof 33 which is shown in full line in the drawing to the outboard position, above the face of the building, illustrated in broken line in the drawing. From this outboard position, the capsule may be lowered to the required level under gravity, braking of the davit for this, purpose being controlled by a line 36 from within the capsule.

When subsequently the capsule 30 is to be lifted back to the level of the roof 33, the cables 31 may be retracted by electrical operation of the winch. When the capsule reaches its upper limit against the davits, the davits and capsule are then drawn up the trackways by the winch, until the operation is stopped by a limit switch.

I claim:

1. An escape system for enabling occupants to escape from the upper levels of a building, comprising lift means selected from the group consisting of davits and cranes mounted at a position located at an upper level of said building, at least two fire-resistant cables depending from said lift means, a fire-resistant substantially airtight vessel of a smooth external generally rounded shape to minimize the effect of wind, said vessel being attached to the respective cables at spaced-apart points on said vessel, which is suspended at the upper levels of said building, bridge means pivotally attached to said vessel for pivoting between a first position in which the bridge means is stowed when not in use and a second position in which the bridge means affords access for personnel from said building into said vessel, drive means for said lift means, mounted upon said building, whereby said lift means may be operated to retract said cables and thereby raise said vessel from a lower position to a higher position, and brake means, operable from within said vessel, to control lowering of said vessel by gravity from a higher position to a lower position.

2. An escape system according to claim 1, wherein said vessel is generally spherical or cylindrical.

3. An escape system according to claim 2, wherein said vessel is formed of a fire-resistant material selected from the group consisting of steel, metal alloys and glass-reinforced, fire-resistant plastics.

4. An escape system according to claim 3, having means for drenching the outside surface of said vessel with water or for surrounding said vessel with a water mist curtain.

5. An escape system according to claim 3, wherein said bridge means is pivoted upon said vessel at a point at or adjacent to the lower edge of said bridge means and forms a closed door to said vessel when said bridge means is in said first position.

6. An escape system for enabling occupants to escape from the upper levels of a building, comprising lift means selected from the group consisting of davits and cranes mounted at a position at an upper level of said building, at least two fire-resistant cables depending from said lift means, a fire-resistant, substantially airtight, generally cylindrical vessel with convex end portions to minimize the effect of wind, said vessel being attached to the respective cables at spaced-apart points on said vessel, bridge means pivotally attached to said vessel at a point at or adjacent to the lower edge of said bridge means for pivotal movement between a first position in which said bridge means forms a closed door to said vessel and a second position in which said bridge means affords access for personnel from said building into said vessel, drive means upon said building to retract said cables and thereby lift said vessel, and brake means, operable from within said vessel to control descent of said vessel by gravity on said cables.

7. An escape system according to claim 6, wherein said lift means is mounted for linear movement between a first position in which said vessel is disposed above or upon said building and a second position in which said vessel is suspended above an outer face of said building.

8. An escape system according to claim 6, wherein the vessel is provided with its own source of a life-supporting atmosphere.

* * * * *